United States Patent [19]

Sensabaugh, Jr. et al.

[11] Patent Number: 5,076,292

[45] Date of Patent: Dec. 31, 1991

[54] SMOKING ARTICLE

[75] Inventors: Andrew J. Sensabaugh, Jr., Winston-Salem; Henry T. Ridings, Lewisville; John H. Reynolds, IV, Winston-Salem, all of N.C.

[73] Assignee: R. J. Reynolds Tobacco Company, Winston-Salem, N.C.

[21] Appl. No.: 88,935

[22] Filed: Aug. 24, 1987

Related U.S. Application Data

[63] Continuation of Ser. No. 650,604, Sep. 14, 1984, Pat. No. 4,793,365.

[51] Int. Cl.[5] ..... A24D 1/00; A24D 1/02

[52] U.S. Cl. ..... 131/194; 131/336; 131/198.1; 131/198.2

[58] Field of Search ..... 131/194, 336, 198.1, 131/198.2, 365

[56] References Cited

U.S. PATENT DOCUMENTS

| | | |
|---|---|---|
| 235,885 | 12/1880 | Lindsley . |
| 346,025 | 7/1886 | Cook . |
| 492,676 | 2/1893 | Harris . |
| 1,437,956 | 12/1922 | Blair . |
| 1,605,059 | 11/1926 | Oakes . |
| 1,770,616 | 7/1930 | Kean . |
| 1,952,352 | 3/1934 | Banks . |
| 2,108,860 | 2/1938 | Kaufman . |
| 2,349,551 | 5/1944 | Helm . |
| 2,907,686 | 10/1959 | Siegel . |
| 3,081,777 | 3/1963 | Sipos . |
| 3,144,024 | 8/1964 | Eichwald . |
| 3,200,819 | 8/1965 | Gilbert . |
| 3,236,244 | 2/1966 | Irby . |

(List continued on next page.)

FOREIGN PATENT DOCUMENTS

| | | |
|---|---|---|
| 276250 | 7/1965 | Australia . |
| 687136 | 5/1964 | Canada . |
| 0074201 | 3/1983 | European Pat. Off. . |
| EPO117355 | 9/1984 | European Pat. Off. . |
| 1167717 | 3/1971 | Fed. Rep. of Germany . |
| 1692936 | 1/1972 | Fed. Rep. of Germany . |
| 2704218 | 2/1977 | Fed. Rep. of Germany . |
| 582489 | 10/1976 | Switzerland . |
| 956544 | 4/1964 | United Kingdom . |
| 1185887 | 3/1970 | United Kingdom . |
| 1597105 | 9/1981 | United Kingdom . |
| 1431045 | 4/1986 | United Kingdom . |

OTHER PUBLICATIONS

Guinness Book of World Records, Sterling Publishing Co., 1966, p. 194.

Guinness World Book of Records, pp. 242–243 (1985 edition).

Ames et al., Mutation Research, 31:347 (1975).

Nagas et al., Mutation Research, 42:335 (1977).

Maron et al., Mutation Research, 113:173 (1983).

*Primary Examiner*—V. Millin

*Attorney, Agent, or Firm*—Grover M. Myers; David G. Conlin

[57] ABSTRACT

The present invention relates to a smoking article which produces an aerosol that resembles tobacco smoke, but contains no more than a minimal amount of incomplete combustion or pyrolysis products.

The smoking article of the present invention provides an aerosol "smoke" which is chemically simple, consisting essentially of oxides of carbon, air, water, and the aerosol which carries any desired flavorants or other desired volatile materials, and trace amounts of other materials. The aerosol "smoke" has no significant mutagenic activity as measured by the Ames Test. In addition, the article may be made virtually ashless so that the user does not have to remove any ash during use.

One embodiment of the present smoking article comprises a short combustible carbonaceous fuel element; a short heat stable, preferably carbonaceous substrate bearing an aerosol forming substance, and a relatively long mouthend piece. The fuel element and the substrate are arranged in a heat exchange relationship, thereby causing aerosol formation without significant degradation of the aerosol former.

23 Claims, 3 Drawing Sheets

U.S. PATENT DOCUMENTS 3,258,015 6/1966 Ellis .
3,280,823 10/1966 Bauley .
3,288,146 11/1966 Bauley .
3,297,476 2/1967 Noznick .
3,339,558 9/1967 Waterbury .
3,356,094 12/1967 Ellis .
3,424,171 1/1969 Rooker .
3,498,299 3/1970 White .
3,516,417 6/1970 Moses .
3,525,582 8/1970 Waterbury .
3,529,602 9/1970 Hind .
3,545,448 12/1970 Morman .
3,584,630 6/1971 Inskeep .
3,586,005 6/1971 Lippman .
3,608,560 9/1971 Briskin .
3,614,956 3/1972 Thornton .
3,667,478 6/1972 Waterbury .
3,713,451 1/1973 Bromberg .
3,738,374 6/1973 Bennett .
3,831,609 8/1974 Briskin .
3,834,398 9/1974 Briskin .
3,861,401 1/1975 Briskin .
3,861,402 1/1975 Briskin .
3,880,172 4/1975 Anderson .
3,885,574 5/1975 Borthwick .
3,894,543 7/1975 Anderson .
3,916,914 11/1975 Brooks .
3,931,824 1/1976 Miano .
3,943,941 3/1976 Boyd .
3,943,942 3/1976 Anderson .
3,972,335 8/1976 Tigglebeck .
4,008,723 2/1977 Borthwick .
4,014,349 3/1977 Morman .
4,019,520 4/1977 Strubel .
4,019,521 4/1977 Briskin .
4,027,679 7/1977 Kaswan .
4,044,777 8/1977 Boyd .
4,055,191 10/1977 Norman .
4,079,742 3/1978 Rainer .
4,123,592 10/1978 Rainer .
4,133,317 1/1979 Briskin .
4,186,756 2/1980 Takemoto .
4,195,645 4/1980 Bradley .
4,216,784 8/1980 Norman .
4,219,031 8/1980 Rainer .
4,219,032 8/1980 Tabatznik et al. .
4,284,089 8/1981 Ray .
4,286,604 9/1981 Ehretsman .
4,289,149 10/1981 Kyriakou .
4,326,514 4/1982 Hardwick .
4,340,072 7/1982 Bolt .
4,347,855 9/1982 Lanzillotti .
4,391,285 7/1983 Burnett .
4,474,191 10/1984 Steiner ..... 131/198.2
4,481,958 11/1984 Rainer et al. .
4,570,650 2/1986 Sirota .

SMOKING ARTICLE

CROSS REFERENCE TO RELATED APPLICATION

This application is a continuation of copending U.S. application Ser. No. 650,604, filed 14 Sept. 1984 now U.S. Pat. No. 4,793,365.

BACKGROUND OF THE INVENTION

The present invention relates to a smoking article which produces an aerosol that resembles tobacco smoke which contains no more than a minimal amount of incomplete combustion or pyrolysis products.

Many smoking articles have been proposed through the years, especially over the last 20 to 30 years. But none of these products has ever realized any commercial success.

Tobacco substitutes have been made from a wide variety of treated and untreated plant material, such as cornstalks, eucalyptus leaves, lettuce leaves, corn leaves, cornsilk, alfalfa, and the like. Numerous patents teach proposed tobacco substitutes made by modifying cellulosic materials, such as by oxidation, by heat treatment, or by the addition of materials to modify the properties of cellulose. One of the most complete lists of these substitutes is found in U.S. Pat. No. 4,079,742 to Rainer et al. Despite these extensive efforts, it is believed that none of these products has been found to be completely satisfactory as a tobacco substitute.

Many proposed smoking articles have been based on the generation of an aerosol or a vapor. Some of these products produce an aerosol or a vapor without heat. See, e.g., U.S. Pat. No. 4,284,089 to Ray. However, the aerosols or vapors from these articles fail to adequately simulate tobacco smoke.

Some proposed aerosol generating smoking articles have used a heat or fuel source in order to produce an aerosol. However, none of these articles has ever achieved any commercial success, and it is believed that none has ever been widely marketed. The absence of such smoking articles from the marketplace is believed to be due to a variety of reasons, including insufficient aerosol generation, both initially and over the life of the product, poor taste, off-taste due to the thermal degradation of the smoke former and/or flavor agents, the presence of substantial pyrolysis products and sidestream smoke, and unsightly appearance.

One of the earliest of these proposed articles was described by Siegel in U.S. Pat. No. 2,907,686. Siegel proposed a cigarette substitute which included an absorbent carbon fuel, preferably a 2½ inch stick of charcoal, which was burnable to produce hot gases, and a flavoring agent carried by the fuel, which was adapted to be distilled off incident to the production of the hot gases. Siegel also proposed that a separate carrier could be used for the flavoring agent, such as a clay, and that a smoke-forming agent, such as glycerol, could be admixed with the flavoring agent. Siegel's proposed cigarette substitute would be coated with a concentrated sugar solution to provide an impervious coat and to force the hot gases and flavoring agents to flow toward the mouth of the user. It is believed that the presence of the flavoring and/or smoke-forming agents in the fuel of Siegel's article would cause substantial thermal degradation of those agents and an attendant off-taste. Moreover, it is believed that the article would tend to produce substantial sidestream smoke containing the aforementioned unpleasant thermal degradation products.

Another such article was described by Ellis et al. in U.S. Pat. No. 3,258,015. Ellis et al. proposed a smoking article which has an outer cylinder of fuel having good smoldering characteristics, preferably fine cut tobacco or reconstituted tobacco, surrounding a metal tube containing tobacco, reconstituted tobacco, or other source of nicotine and water vapor. On smoking, the burning fuel heated the nicotine source material to cause the release of nicotine vapor and potentially aerosol generating material, including water vapor. This was mixed with heated air which entered the open end of the tube. A substantial disadvantage of this article was the ultimate protrusion of the metal tube as the tobacco fuel was consumed. Other apparent disadvantages of this proposed smoking article include the presence of substantial tobacco pyrolysis products, the substantial tobacco sidestream smoke and ash, and the possible pyrolysis of the nicotine source material in the metal tube.

In U.S. Pat. No. 3,356,094, Ellis et al. modified their original design to eliminate the protruding metal tube. This new design employed a tube made out of a material, such as certain inorganic salts or an epoxy bonded ceramic, which became frangible upon heating. This frangible tube was then removed when the smoker eliminated ash from the end of the article. Even though the appearance of the article was very similar to a conventional cigarette, apparently no commercial product was ever marketed.

In U.S. Pat. No. 3,738,374, Bennett proposed the use of carbon or graphite fibers, mat, or cloth associated with an oxidizing agent as a substitute cigarette filler. Flavor was provided by the incorporation of a flavor or fragrance into the mouthend of an optional filter tip.

U.S. Pat. Nos. 3,943,941 and 4,044,777 to Boyd et al. and British Patent 1,431,045 proposed the use of a fibrous carbon fuel which was mixed or impregnated with volatile solids or liquids which were capable of distilling or subliming into the smoke stream to provide "smoke" to be inhaled upon burning of the fuel. Among the enumerated smoke producing agents were polyhydric alcohols, such as propylene glycol, glycerol, and 1,3 butylene glycol, and glyceryl esters, such as triacetin. Despite Boyd et al.'s desire that the volatile materials distill without chemical change, it is believed that the mixture of these materials with the fuel would lead to substantial thermal decomposition of the volatile materials and to bitter off-tastes. Similar products were proposed in U.S. Pat. No. 4,286,604 to Ehretsmann et al. and in U.S. Pat. No. 4,326,544 to Hardwick et al.

Bolt et al., in U.S. Pat. No. 4,340,072 proposed a smoking article having a fuel rod with a central air passageway and a mouthend chamber containing an aerosol forming agent. The fuel rod preferably was a molding or extrusion of reconstituted tobacco and/or tobacco substitute, although the patent also proposed the use of tobacco, a mixture of tobacco substitute material and carbon, or a sodium carboxymethylcellulose (SCMC) and carbon mixture. The aerosol forming agent was proposed to be a nicotine source material, or granules or microcapsules of a flavorant in triacetin or benzyl benzoate. Upon burning, air entered the air passage where it was mixed with combustion gases from the burning rod. The flow of these hot gases reportedly ruptured the granules or microcapsules to release the volatile material. This material reportedly formed an aerosol and/or was transferred into the mainstream aerosol. It is believed that the articles of Bolt et al., due in part to the long fuel rod, would produce insufficient aerosol from the aerosol former to be acceptable, especially in the early puffs. The use of microcapsules or granules would further impair aerosol delivery because of the heat needed to rupture the wall material. Moreover, total aerosol delivery would appear dependent on the use of tobacco or tobacco substitute materials, which would provide substantial pyrolysis products and sidestream smoke which would not be desirable in this type smoking article.

U.S. Pat. No. 3,516,417 to Moses proposed a smoking article, with a tobacco fuel, which was identical to the article of Bolt et al., except that Moses used a double density plug of tobacco in lieu of the granular or microencapsulated flavorant of Bolt et al. See FIG. 4, and col. 4, 1. 17–35. This article would suffer many of the same problems as the articles proposed by Bolt et al.

Thus, despite decades of interest and effort, there is still no smoking article on the market which provides the benefits and advantages associated with conventional cigarette smoking.

SUMMARY OF THE INVENTION

The present invention relates to a smoking article which is capable of producing substantial quantities of aerosol, both initially and over the useful life of the product, without significant thermal degradation of the aerosol former and without the presence of substantial pyrolysis or incomplete combustion products or sidestream smoke. Thus, the article of the present invention is able to provide the user with the sensations and benefits of cigarette smoking without burning tobacco.

In one aspect of the present invention, the smoking article has a short, combustible carbonaceous fuel element, generally less than about 30 mm long, which is substantially free of volatile organic material. Preferably, the fuel element is less than about 15 mm in length. A physically separate aerosol generating means, such as a substrate or chamber containing an aerosol forming substance, is located in a conductive heat exchange relationship to the fuel element. Preferably, the heat exchange relationship is achieved by providing a heat conductive member which efficiently conducts or transfers heat from the burning fuel element to the aerosol generating means. Advantageously, the aerosol generating means is a relatively short body, again generally less than about 30 mm long, which either abuts or is adjacent to the nonlighting end of the fuel element. Preferably, the aerosol generating means is a thermally stable substrate impregnated with one or more aerosol forming substances and is less than about 15 mm in length.

The smoking article of the present invention normally is provided with a mouthend piece including means, such as a longitudinal passage, for delivering the volatile material produced by the aerosol generating means to the user. Advantageously, the article has the same overall dimensions as a conventional cigarette, and as a result, the mouthend piece and the aerosol delivery means usually extend over more than one-half the length of the article. Alternatively, the fuel element and the aerosol generating means may be produced without a built-in mouthpiece or aerosol delivery means, for use as a disposable cartridge with a separate, reusable mouthpiece.

Upon lighting, the fuel element generates heat which is used to volatilze the aerosol forming substance or substances contained in the substrate or chamber. These volatile materials are then drawn toward the mouthend, especially during puffing, and into the user's mouth, akin to the smoke of a conventional cigarette. Because the fuel element is relatively short, the hot, burning fire cone is always close to the aerosol generating body, which maximizes heat transfer to the aerosol generating means and the resultant production of aerosol. The use of a relatively short, low mass aerosol generating body, in close proximity to the short fuel element, also increases aerosol production by minimizing the heat sink effect of the substrate or carrier. Because the aerosol forming substance is physically separate from the fuel element, it is exposed to substantially lower temperatures than are present in the burning fire cone, which minimizes the possibility of thermal degradation of the aerosol former. Moreover, the use of a carbonaceous fuel element which is substantially free of volatile organic material eliminates the presence of substantial pyrolysis or incomplete combustion products and the presence of substantial sidestream smoke.

In another important aspect of the present invention, the smoking article is provided with means for conducting heat from the fuel element to the aerosol generating means other than the mere end to end abutment of the fuel element to the aerosol generating means. Preferably, the heat conducting means is a heat conducting member, such as a metal foil, or a metal rod, which advantageously contacts both the fuel element and the aerosol generating means. Contact of the metal foil is preferably along the external longitudinal surfaces of the fuel element and the aerosol generator. Contact of the metal rod is preferably made by embedding the rod centrally within the fuel element and the aerosol generator.

The use of the heat conducting means of the present invention substantially increases heat transfer to the aerosol generator which, in turn, volatilizes larger quantities of the aerosol former for delivery to the user. This increased heat transfer is, in part, due to the fact that the heat conducting means transfers heat both during a puff and during smolder, whereas convective heat transfer, which is primarily relied upon in most prior art aerosol generating articles, primarily delivers heat only during a puff. This increased heat transfer makes more efficient use of the available fuel energy, reduces the amount of fuel needed, helps deliver aerosol on the initial puffs, and substantially reduces material costs of the fuel. Further, it is believed that conductive heat transfer reduces the carbon fuel combustion temperature and thus greatly reduces the $CO/CO_2$ ratio.

In a particularly preferred embodiment of the invention, the fuel element is a pressed carbon plug or mass of carbonized fibers, generally about 10 mm or less in length, which is provided with at least one longitudinal passage to aid heat transfer to the aerosol generator. The aerosol generating means is a thermally stable, preferably carbonaceous substrate about 10 mm or less in length which is impregnated with one or more aerosol forming substances, such as a mixture of glycerol and propylene glycol. This substrate may be provided with an axial passage which may be aligned with an axial passage in the fuel element. This fuel element and substrate are joined by an encircling piece of heat conductive aluminum foil which envelops the longitudinal periphery of the non-lighting end of the fuel element and at least a portion, and preferably all, of the longitudinal periphery of the substrate.

Preferred embodiments of the invention are capable of delivering at least 0.6 mg of aerosol, measured as wet total particulate matter, in the first 3 puffs, when smoked under standard FTC smoking conditions. More preferably, preferred embodiments of the invention are capable of delivering 1.5 mg or more of aerosol in the first 3 puffs. Most preferably, preferred embodiments of the invention are capable of delivering 3 mg or more of aerosol in the first 3 puffs when smoked under standard FTC smoking conditions. Moreover, preferred embodiments of the invention deliver an average of at least about 0.8 mg of wet total particulate matter per puff under standard FTC smoking conditions.

The smoking article of the present invention also may include a charge or plug of tobacco which is used to add a tobacco flavor to the aerosol. Preferably, the tobacco is placed at the mouthend of the aerosol generating means, or it is mixed with the carrier for the aerosol forming substance. Flavoring agents also may be incorporated into the article to flavor the aerosol delivered to the user.

The smoking article of the present invention also provides an aerosol "smoke" which is chemically simple, consisting essentially of air, oxides of carbon water, and the aerosol which carries any desired flavorants or other desired volatile materials, and trace amounts of other materials. The aerosol "smoke" has no significant mutagenic activity using the Ames test discussed hereinafter. In addition, the article may be made virtually ashless so that the user does not have to remove any ash during use.

In another important aspect of the invention, the aerosol forming substance may be replaced, in whole or in part, by a volatile, nonaerosol substance, such as a flavoring agent and/or other volatile solid or liquid materials, to deliver flavors and/or other materials to the user, in aerosol or vapor form.

The smoking article of the present invention is described in greater detail in the accompanying drawings and in the detailed description of the invention which follows.

DETAILED DESCRIPTION OF THE INVENTION

Figure 1:
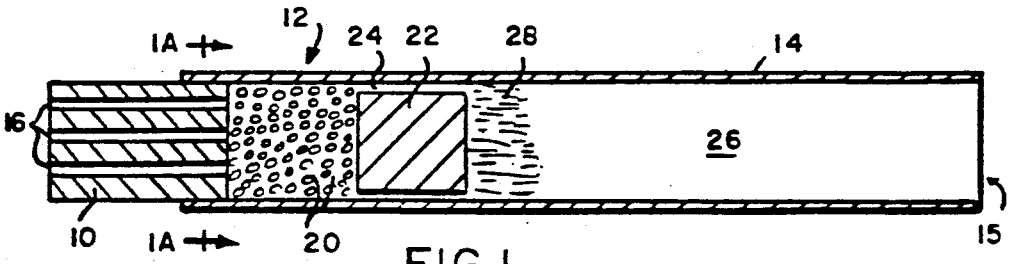
FIGS. 1 through 9 are longitudinal, sectional views of various embodiments of the invention.
Figure 1A:
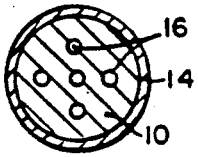
FIG. 1A is a sectional view of the embodiment of FIG. 1, taken along lines 1A—1A in FIG. 1.

The embodiment of the invention illustrated in FIG. 1, which preferably has the diameter of a conventional cigarette, includes a short, combustible carbonaceous fuel element 10, an abutting aerosol generating means 12, and a foil lined paper tube 14, which forms the mouthend 15 of the article. In this embodiment, fuel element 10 is a blow pipe charcoal, a carbonized wood, which is provided with five longitudinally extending holes 16. See FIG. 1A. The fuel element 10, which is about 20 mm long, optionally may be wrapped with cigarette paper to improve lighting of the charcoal fuel. This paper may be treated with known burn additives.

Aerosol generating means 12 includes a plurality of glass beads 20 coated with an aerosol forming substance or substances, such as glycerin. The glass beads are held in place by a porous disc 22, which may be made of cellulose acetate. This disc may be provided with a series of peripheral grooves 24 which provide passages between the disc and the foil lined tube 14.

The foil lined paper tube 14, which forms the mouthend of the article, surrounds aerosol generating means 12 and the rear, non-lighting end of fuel element 10. The tube also forms an aerosol delivery passage 26 between the aerosol generating means 12 and the mouth end 15 of the article.

The article illustrated in FIG. 1 also includes an optional mass or plug of tobacco 28 to contribute flavor to the aerosol. This tobacco charge 28 may be placed at the mouthend of disc 22, as shown in FIG. 1, or it may be placed between glass beads 20 and disc 22. It also may be placed in passage 26 at a location spaced from aerosol generator 12.

Figure 2:
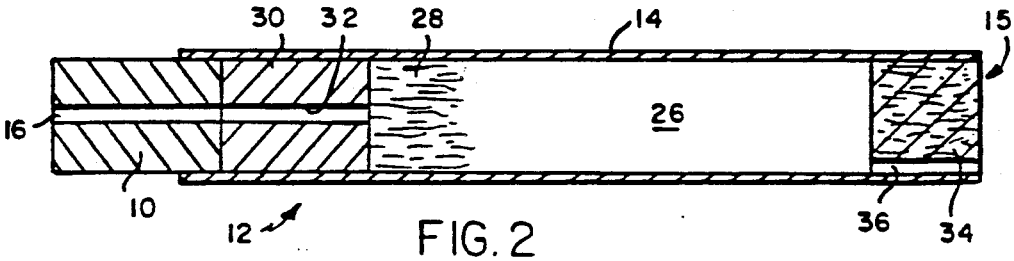
Figure 2A:
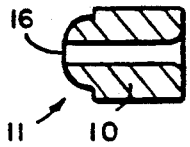
FIG. 2A is a longitudinal view of a modified, tapered fuel element of the embodiment of FIG. 2.

In the embodiment shown in FIG. 2, the short fuel element 10 is a pressed carbon rod or plug, about 20 mm long, which is provided with an axial hole 16. Alternatively, the fuel may be formed from carbonized fibers and preferably also provided with an axial passageway corresponding to hole 16. In this embodiment, aerosol generating means 12 includes a thermally stable conductive carbonaceous substrate 30, such as a plug of porous carbon, which is impregnated with an aerosol forming substance or substances. This substrate may be provided with an optional axial passageway 32, as is shown in FIG. 2. This embodiment also includes a mass of tobacco 28 which is preferably placed at the mouthend of substrate 30. For appearance sake, this article also includes an optional high porosity cellulose acetate filter 34, which may be provided with peripheral grooves 36 to provide passages for the aerosol forming substance between filter 34 and foil tube 14. Optionally, as shown in FIG. 2A, the lighting end 11 of the fuel element may be tapered to improve lightability.

Upon lighting any of the aforesaid embodiments, the carbonaceous fuel element 10 burns, which generates the heat used to volatilize the aerosol forming substance or substances present in aerosol generating means 12. These volatile materials are then drawn down passage 26 toward the mouthend 15, especially during puffing, and into the user's mouth, like the smoke of a conventional cigarette. Because the aerosol forming substance is physically separate from the fuel element, it is exposed to substantially lower temperatures than are present in the burning fire cone, which minimizes the possibility of thermal degradation of the aerosol former. This also results in aerosol production during puffing, but little or no aerosol production during smolder. In addition, the use of a carbonaceous fuel element and a physically separate aerosol generator eliminate the presence of substantial pyrolysis or incomplete combustion products and avoid the production of substantial sidestream smoke.

If a charge of tobacco is employed, the hot vapors of the aerosol former are swept through the bed of tobacco to extract and vaporize the volatile components in the tobacco, without the need for tobacco combustion. Thus the user of this smoking article receives an aerosol which contains the qualities and flavors of natural tobacco without the combustion products produced by a conventional cigarette.

Because of the small size and burning characteristics of the carbonaceous fuel elements employed in the present invention, the fuel element usually begins burning over substantially all of its exposed length within a few puffs. Thus, the portion of the fuel element adjacent to the aerosol generator 12 becomes hot quickly, which significantly increases heat transfer to the aerosol generator, especially during the early and middle puffs. Because the fuel element is so short, there is never a long section of nonburning fuel to act as a heat sink, as in the prior art thermal aerosol articles. Heat transfer, and therefore aerosol delivery, also is enhanced by the use of holes 16 through the fuel, which draw hot gases to the aerosol generator, especially during puffing.

The presence of foil lined tube 14, which couples the nonlighting end of fuel 10 to aerosol generator 12, also increases heat transfer to the aerosol generator. The foil also helps to extinguish the fire cone. When only a small amount of the unburned fuel remains, heat loss through the foil acts as a heat sink which helps to extinguish the fire cone.

The foil used in this article is typically an aluminum foil of 0.35 mils (0.0089 mm) in thickness, but the thickness and/or the type of metal employed may be varied to achieve any desired degree of heat transfer. Other types of heat conducting members such as Grafoil, available from Union Carbide, also may be employed.

In the foregoing embodiments of the invention, short fuel element 10, foil lined tube 14, and passages 16 in the fuel cooperate with the aerosol generator to provide a system which is capable of producing substantial quantities of aerosol throughout the life of the fuel element, and especially during the early and middle puffs. The close proximity of the fire cone to the aerosol generator after a few puffs, together with the conductive metallic foil, results in heat delivery during puffs and during the relatively long period of smolder between puffs. (Standard FTC Smoking Conditions of two second puffs separated by 58 seconds of smolder.) While not wishing to be bound by theory, it is believed that the aerosol generator is maintained at relatively high temperatures between puffs and that the additional heat delivered during puffs, which is significantly increased by the hole or holes 16 in the fuel element, is primarily utilized to vaporize the aerosol forming substance. This increased heat transfer makes more efficient use of the available fuel energy, reduces the amount of fuel needed, and helps deliver aerosol on the initial puffs. Further, the conductive heat transfer utilized in the present invention is believed to reduce the carbon fuel combustion temperature which, it is believed, reduces the $CO/CO_2$ ratio in the combustion products produced by the fuel. See, e.g., C. Hagg, *General Inorganic Chemistry* at p. 592 (John Wiley & Sons, 1969).

Figure 3:
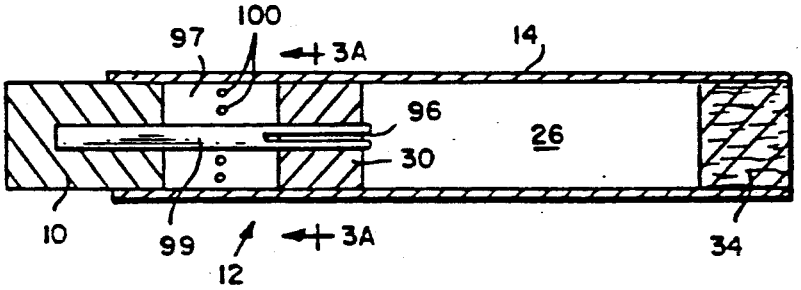

The embodiment of the invention illustrated in FIG. 3, includes a short combustible carbonaceous fuel element 10, connected to aerosol generating means 12 by a heat conductive rod 99 and by a foil lined paper tube 14, which also forms the mouthend 15 of the article. In this embodiment, fuel element 10 may be blowpipe charcoal or a pressed or extruded carbon rod or plug or other carbonaceous fuel source.

Aerosol generating means 12 includes a thermally stable carbonaceous substrate 30, such as a plug of porous carbon, which is impregnated with an aerosol forming substance or substances. This embodiment includes a void space 97 between the fuel element 10 and the substrate 30. The portion of the foil lined tube 14 surrounding this void space includes a plurality of peripheral holes 100 which permit sufficient air to enter the void space to provide appropriate pressure drop.

Figure 3A:
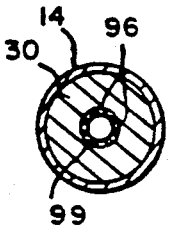
FIG. 3A is a sectional view of the embodiment of FIG. 3, taken along lines 3A—3A in FIG. 3.

As shown in FIGS. 3 and 3A, the heat conducting means includes a conductive rod 99 and the foil lined tube 14. The rod 99, preferably formed of aluminum, has at least one, preferably from 2 to 5, peripheral grooves 96 therein, to allow air passage through the substrate. The article of FIG. 3 has the advantage that the air introduced into the void space 97 contains less carbon oxidation products because it is not drawn through the burning fuel.

In general, the combustible carbonaceous fuel elements which may be employed in practicing the invention are generally less than about 30 mm long. Advantageously the fuel element is about 20 mm or less in length, preferably about 15 mm or less in length. In most current preferred embodiments, the fuel element is between about 3 mm to about 10 mm in length. These lengths are sufficient to provide fuel for at least about 7 to 10 puffs, the normal number of puffs obtained with a conventional cigarette under FTC smoking conditions. Preferably, the fuel is provided with means for passing hot gases to the substrate, such as one or more longitudinally extending holes 16 in FIGS. 1 and 2. It is believed the holes also aid in decreasing heat transfer in later puffs by increasing in size.

The fuel elements are primarily formed of a carbonaceous material. Preferably, the carbon content of the fuel is at least 80%, most preferably about 90% or more, by weight. High carbon content fuels are preferred because they produce minimal pyrolysis and incomplete combustion products, little or no visible sidestream smoke, minimal ash, and high heat capacity. However, lower carbon content fuel elements are within the scope of this invention, especially where a nonburning inert filler is used.

The carbonaceous materials used in or as the fuel may be derived from virtually any of the numerous carbon sources known to those skilled in the art. Preferably, the carbonaceous material is obtained by the pyrolysis or carbonization of cellulosic materials, such as wood, cotton, rayon, tobacco, coconut, paper, and the like, although carbonaceous materials from other sources may be used.

In most instances, the carbonaceous material should be capable of being ignited by a conventional cigarette lighter without the use of an oxidizing agent. Burning characteristics of this type may generally be obtained from a cellulosic material which has been pyrolyzed at temperatures between about 400° C. to about 1000° C., preferably between about 500° C. to about 950° C., in an inert atmosphere or under a vacuum. The pyrolysis time is not believed to be important, as long as the temperature at the center of the pyrolyzed mass has reached the aforesaid temperature range for at least a few minutes.

While undesirable in most cases, carbonaceous materials which require the use of an oxidizing agent to render them ignitable by a cigarette lighter are within the scope of this invention, as are carbonaceous materials which require the use of a glow retardant or other type of combustion modifying agent. Such combustion modifying agents are disclosed in many prior art patents and publications and are known to those of ordinary skill in the art.

The carbonaceous fuel elements used in practicing the invention are substantially free of volatile organic material. By that, it is meant that the fuel element is not impregnated or mixed with substantial amounts of volatile organic materials, such as volatile aerosol forming or flavoring agents, which could degrade at the combustion temperatures of the fuel. However, small amounts of water, which are naturally absorbed by the fuel, may be present in the fuel. Similarly, small amounts of aerosol forming substances may migrate from the aerosol generator and thus also may be present in the fuel.

A preferred carbonaceous fuel element is a pressed carbon plug prepared from porous carbon and a binder, by conventional pressure forming techniques. A preferred activated carbon for pressure forming is PCB-G, and a preferred non-activated carbon is PXC, both available from Calgon Carbon Corporation, Pittsburgh, Pa. Other preferred nonactivated carbons for pressure forming are prepared from pyrolyzed cotton linters or pyrolized papers, such as Grande Prairie Canadian Kraft available from Buckeye Cellulose Corp., Memphis, Tenn.

The binders which may be used in preparing such a fuel element are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, and other cellulose derivatives, such as methylcellulose and carboxymethylcellulose (CMC).

A wide range of binder concentrations can be utilized. Preferably, the amount of binder is limited to minimize contribution of the binder to undesirable combustion products. On the other hand, sufficient binder must be included to hold the fuel element together during manufacture and use. The amount used will thus depend on the cohesiveness of the carbon in the fuel.

In general, the fuel is prepared by admixing from about 50 to 99 weight percent, preferably about 80 to 95 weight percent, of the carbonaceous material, with from 1 to 50 weight percent, preferably about 5 to 20 weight percent of the binder, with sufficient water to make a paste. The paste is homogenized by mixing and then dried to reduce the moisture content to about 5 to 10 weight percent. The dried paste is then ground to a particle size of about −20 to +100 size. This ground material is treated with water to raise the moisture level to about 30 weight percent, and the moist solid is fed to forming means, such as a conventional pill press, wherein a die punch pressure of from 1,000 pounds (455 kg) to 10,000 pounds (4550 kg), preferably about 5,000 pounds (2273 kg), of load is applied to create a pressed pellet having the desired dimensions. The pressed pellet is then dried at from about 55° to about 100° C., to reduce the moisture content to between 5 to 10 weight percent. The longitudinal passage or passages 16, if desired, may be drilled using conventional techniques, or they may be formed at the time of pressing.

Alternatively, the forming means used may be a standard extruder. In that case, the amount of water used is just sufficient to obtain a stiff dough consistency. The dough is then extruded into the desired shape followed by drying, e.g., at 80° C. overnight.

If desired, the aforesaid pressed carbon fuel element may be pyrolyzed after formation, for example, to about 650° C. for two hours, to convert the binder to carbon and thereby form a virtually 100% carbon fuel plug. Alternatively, a virtually pure carbon plug can be formed by using sufficient pressure.

The pressed carbon fuel elements also may contain one or more additives to improve burning, such as up to about 5 weight percent sodium chloride to improve smoldering characteristics and as a glow retardant. Also, up to about 5 weight percent of potassium carbonate may be included to improve lightability. Additives to improve physical characteristics, such as clays like kaolins, serpentines, attapulgites, and the like also may be used.

Another preferred carbonaceous fuel element is a carbon fiber fuel, which may be prepared by carbonizing a fibrous precursor, such as cotton, rayon, paper, polyacrylonitile, and the like. Generally, pyrolysis at about 650° C. to 1000° C., preferably at about 950° C., for about 30 minutes, in an inert atmosphere or vacuum, is sufficient to produce a suitable carbon fiber with good burning characteristics. Combustion modifying additives also may be added to these preferred fuels.

The aerosol generating means used in practicing the invention is physically separate from the fuel element. By physically separate it is meant that the substrate or body which contains the aerosol forming materials is not mixed with, or a part of, the fuel. As noted previously, this arrangement helps reduce or eliminate thermal degradation of the aerosol forming substance and the presence of sidestream smoke. While not a part of the fuel, the aerosol generator preferably is in a conductive heat exchange relationship with the fuel element. As used herein, a conductive heat exchange relationship is defined as a physical arrangement of the substrate and the fuel element whereby conductive heat transfer from the burning fuel element takes place throughout the burning period of the fuel element. Preferably, the heat exchange relationship is achieved by providing heat conductive means which efficiently conducts or transfers heat from the burning fuel element to the aerosol generating means. In most preferred embodiments, the aerosol generator abuts or is adjacent to the fuel element so that the fuel and the aerosol generator are in a heat exchange relationship throughout the burning of the fuel element.

Preferably, the aerosol generating means includes one or more thermally stable materials which carry one or more aerosol forming substances. As used herein, a thermally stable material is one capable of withstanding the high temperatures, e.g., 400°-600° C., which exist near the fuel without decomposition or burning. The use of such material is believed to help maintain the simple "smoke" chemistry of the aerosol, as evidenced by the lack of Ames test activity which is described in greater detail hereinafter. While not preferred, other aerosol generating means, such as heat rupturable microcapsules, or solid aerosol forming substances, are within the scope of the invention, provided they are capable of releasing sufficient aerosol forming vapors to satisfactorily resemble tobacco smoke.

The thermally stable materials which may be used as the carrier or substrate for the aerosol forming substance are well known to those skilled in the art. Useful carriers should be porous or in particulate form, and must be capable of retaining an aerosol forming compound and releasing a potential aerosol forming vapor upon heating by the fuel. Useful thermally stable materials include thermally stable adsorbent carbons, such as electrode grade carbons, graphite, activated, or nonactivated carbons, and the like. Other suitable materials include inorganic solids such as ceramics, alumina, vermiculite, clays such as bentonite, glass beads, and the like. The currently preferred substrate materials are carbon felts, fibers, and mats, activated carbons, and porous carbons such as PC-25 and PG-60 available from Union Carbide.

The aerosol generating means used in the invention is usually no more than about 30 mm, preferably no more than 20 mm from the lighting end 11 of the article. The aerosol generator is usually less than about 20 mm in length. The preferred length is between about 5 to 15 mm. If a non-particulate substrate is used, it may be provided with one or more holes, such as hole 32 in FIG. 2, to increase the surface area of the substrate and to increase air flow and heat transfer into passageway 26.

The aerosol forming substance or substances used in the invention must be capable of forming an aerosol at the temperatures present in the aerosol generating means. Such substances preferably will be composed of carbon, hydrogen and oxygen, but they may include other materials. The boiling point of the substance and/or the mixture of substances can range up to about 500° C. Substances having these characteristics include polyhydric alcohols, such as glycerin and propylene glycol, as well as aliphatic esters of mono-, di-, or poly-carboxylic acids, such as methyl stearate, dodecandioate, dimethyl tetradodecandioate, and others.

Preferably, the aerosol forming substances will include a mixture of a high boiling, low vapor pressure substance and a low boiling, high vapor pressure substance. It is believed, on early puffs, the low boiling substance will provide most of the initial aerosol, while, when the temperature in the aerosol generator increases, the high boiling substance will provide most of the aerosol.

The preferred aerosol forming substances are polyhydric alcohols, or mixtures of polyhydric alcohols. A more preferred aerosol former is a mixture of glycerin and propylene glycol, which most preferably contains about 50 weight percent of each.

The aerosol forming substance may be dispersed on or within the carrier or substrate material, in a concentration sufficient to permeate or coat the material, by any known technique. For example, the aerosol forming substance may be applied full strength or in a dilute solution by dipping, spraying, vapor deposition, or similar techniques. Solid aerosol forming components may be admixed with the substrate material and distributed evenly throughout prior to formation of the final substrate.

While the loading of the aerosol forming substance will vary from carrier to carrier and from aerosol forming substance to aerosol forming substance, the amount of liquid aerosol forming substances may generally vary from about 20 mg to about 120 mg, preferably from about 35 mg to about 85 mg, and most preferably from about 45 mg to about 65 mg. As much as possible of the aerosol former carried on the substrate should be delivered to the user as WTPM. Preferably, above about 2 weight percent, more preferably above about 15 weight percent, and most preferably above about 20 weight percent of the aerosol former carried on the substrate is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, these optional agents may be placed between the aerosol generator and the mouthend, such as in a separate substrate or chamber in passage 26 which connects the aerosol generator to the mouthend, or in the optional tobacco charge. If desired, these volatile agents may be used in lieu of part or all of the aerosol forming substance, so that the article delivers a nonaerosol flavor or other material to the user.

Articles of the type disclosed herein may be used or may be modified for use as drug delivery articles, for delivery of volatile pharmacologically or physiologically active materials such as ephedrine, metaproterenol, terbutaline or the like.

In most embodiments of the invention, the fuel and aerosol generator will be attached to a mouthend piece, such as foil lined tube 14, although a mouthend piece may be provided separately, e.g., in the form of a cigarette holder. This element of the article provides the enclosure which channels the vaporized aerosol forming substance into the mouth of the user. Due to its length, preferably about 50 to 60 mm or more, it also keeps the hot fire cone away from the mouth and fingers of the user.

Suitable mouthpieces should be inert with respect to the aerosol forming substances, should have a water or liquid proof inner layer, should offer minimum aerosol loss by condensation or filtration, and should be capable of withstanding the temperature at the interface with the other elements of the article. Preferred mouthpieces include the foil lined tube of FIGS. 1-3 and the cellulose-acetate tube employed in the embodiment of FIG. 4, as described hereinafter. Other suitable mouthpieces will be apparent to those of ordinary skill in the art.

The mouthend pieces of the invention may include an optional "filter" tip, which is used to give the article the appearance of the conventional filtered cigarette. Such filters include low density cellulose acetate filters and hollow or baffled plastic filters, such as those made of polypropylene. In addition, the entire length of article or any portion thereof may be overwrapped with cigarette paper.

The aerosol produced by the preferred articles of the present invention is chemically simple, consisting essentially of air, oxides of carbon, the aerosol which carries any desired flavorants or other desired volatile materials, water, and trace amounts of other materials. The wet total particulate matter (WTPM) produced by the preferred articles of this invention has no mutagenic activity as measured by the Ames test, i.e., there is no significant dose response relationship between the WTPM of the present invention and the number of revertants occurring in standard test micro organisms exposed to such products. According to the proponents of the Ames test, a significant dose dependent response indicates the presence of mutagenic materials in the products tested. See Ames et al., *Mut. Res.*, 31: 347-364 (1975); Nagao et al., *Mut. Res.*, 42: 335 (1977).

A further benefit from the preferred embodiments of the present invention is the relative lack of ash produced during use in comparison to ash from a conventional cigarette. As the preferred carbon fuel source is burned, it is essentially converted to oxides of carbon, with relatively little ash generation, and thus there is no need to dispose of ashes while using the article.

The following embodiments include the current best modes of carrying out the invention as of the filing of this application, many of which are the result of efforts by our co-workers. However, these embodiments are described herein in order to disclose the best known modes for carrying out our invention.

Figure 4:
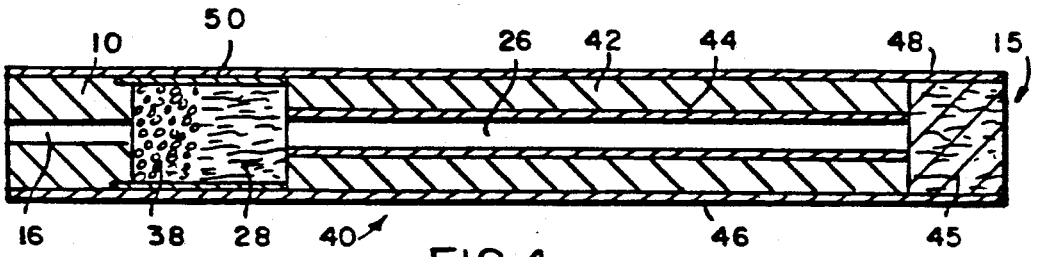

The embodiment illustrated in FIG. 4 includes a fibrous carbon fuel element 10, such as carbonized cotton or rayon. The fuel element includes a single axial hole 16. The substrate 38 of the aerosol generator is a granular, thermally stable carbon. A mass of tobacco 28 is located immediately behind the substrate. This article is provided with a cellulose acetate tube 40, in place of the foil lined tube. This tube 40 includes an annular section 42 of cellulose acetate tow surrounding an optional plastic, e.g., polypropylene tube 44. The mouthend 15 of this element includes a low efficiency cellulose acetate filter plug 45. The entire length of the article is wrapped in cigarette-type paper 46. A cork or white ink coating 48 may be used on the mouthend to simulate tipping. A foil strip 50 is located on the inside of the paper, toward the fuel end of the article. This strip preferably extends from the rear portion of the fuel element to the mouthend of the tobacco charge 28. It may be integral with the paper or it may be a separate piece applied before the paper overwrap.

Figure 5:
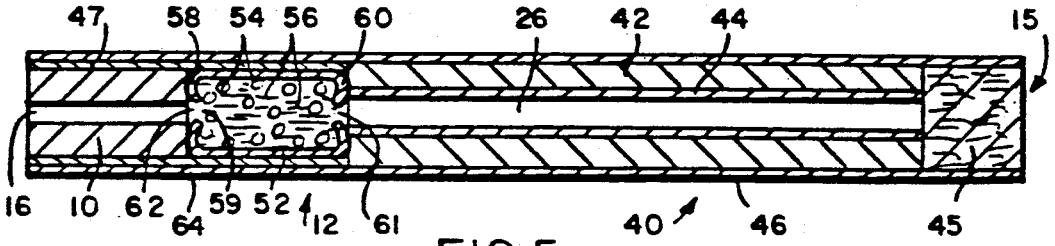

The embodiment of FIG. 5 is similar to that of FIG. 4. In this embodiment, the aerosol generating means 12 is formed by an aluminum macrocapsule 52 which is filled with a granular substrate or, as shown in the drawing, a mixture of a granular substrate 54, and tobacco 56. The macrocapsule 52 is crimped in at its ends 58, 60 to enclose the material inside and to inhibit migration of the aerosol former. The crimped end 58, at the fuel end, preferably abuts the rear end of the fuel element to provide for conductive heat transfer. A void space 62 formed by end 58 also helps to inhibit migration of the aerosol former to the fuel. Holes 59 and 61 are provided to permit the passage of air and the aerosol forming substance. Macrocapsule 52 and fuel element 10 may be united by a conventional cigarette paper 47, as illustrated in the drawing, by a perforated ceramic paper, or a foil strip. If cigarette paper is used, a strip 64 near the rear end of the fuel should be printed or treated with sodium silicate or other known materials which cause the paper to extinguish. The entire length of the article is overwrapped with conventional cigarette paper 46.

Figure 6:
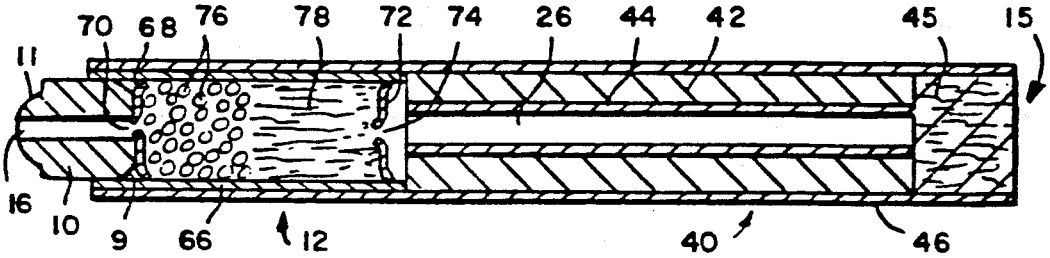

FIG. 6 illustrates another embodiment having a pressed carbon fuel plug 10. In this embodiment, the fuel element has a tapered lighting end 11 for easier lighting and a tapered rear end 9 for easy fitting into a tubular foil wrapper 66. Abutting the rear end of the fuel element is an aluminum disc 68 with a center hole 70. A second, optional aluminum disc 72 with hole 74 is located at the mouthend of the aerosol generator 12. In between is a zone 76 of a particulate substrate and a zone 78 of tobacco. The foil wrapper 66 in which the fuel element is mounted extends back beyond the second aluminum disc 72. This embodiment also includes a hollow cellulose acetate rod 42 with an internal polypropylene tube 44, and a cellulose acetate filter plug 45. The entire length of the article is preferably wrapped with cigarette paper 46.

Figure 7:
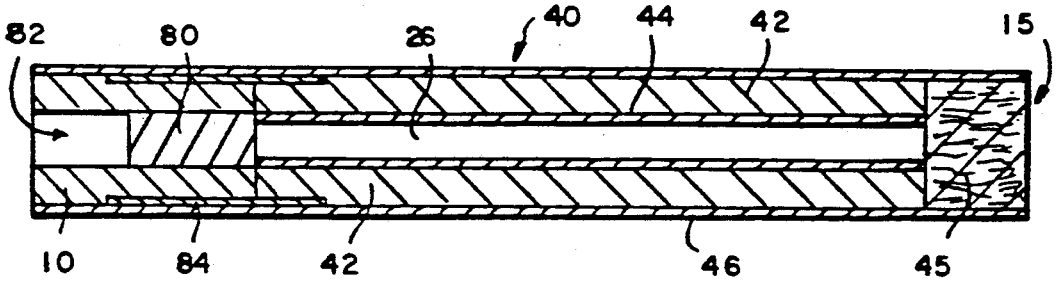

The embodiment shown in FIG. 7 illustrates the use of a substrate 80 embedded within a large cavity 82 in fuel element 10. In this embodiment, the fuel element preferably is formed from an extruded carbon, and the substrate 80 usually is a relatively rigid, porous material. The entire length of the article is wrapped with conventional cigarette paper 46. This embodiment may also include a foil strip 84 to couple fuel element 10 to the cellulose acetate tube 40 and to help extinguish the fuel.

Figure 8:
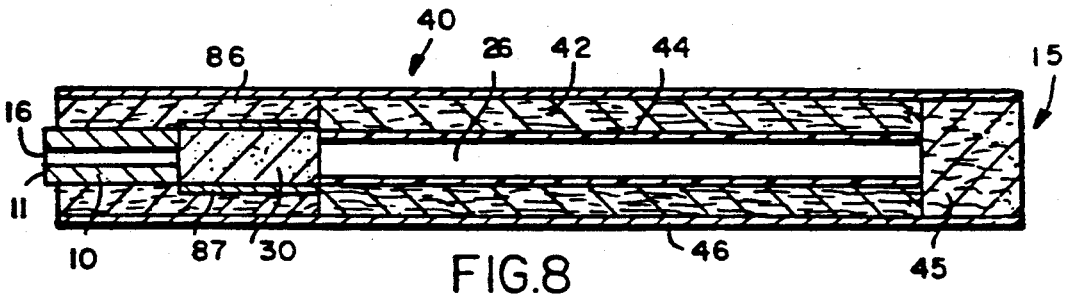
Figure 9:
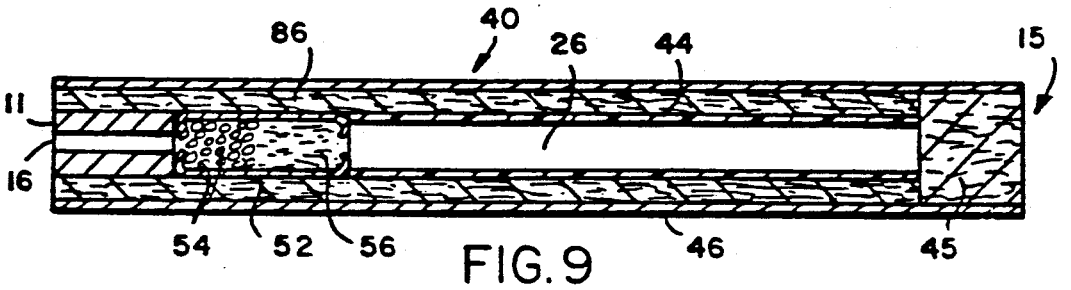

The embodiments shown in FIGS. 8 and 9 include a nonburning fiber jacket 86 around fuel element 10 to insulate and concentrate the heat in the fuel element. These embodiments also help to reduce any fire causing potential of the burning fire cone.

In the embodiment shown in FIG. 8, both fuel element 10 and substrate 30 are located within an annular jacket or tube 86 of ceramic fibers, such as fiberglass.

Nonburning carbon or graphite fibers may be used in place of ceramic fibers. Fuel element 10 is preferably an extruded carbon plug having a hole 16. In the illustrated embodiment, the lighting end 11 extends slightly beyond the edge of jacket 86 for ease of lighting. Substrate 30 is a solid porous carbon material, although other types of substrates may be used. The substrate and the rear portion of the fuel element are surrounded by a piece of aluminum foil 87. As illustrated, this jacketed fuel/substrate unit is coupled to a mouthend piece, such as the elongated cellulose acetate tube 40 shown in the drawing, with an overwrap of conventional cigarette paper 46. The jacket 86 extends to the mouth end of substrate 30, but may replace cellulose acetate rod 42.

In the embodiment shown in FIG. 9, an aluminum macrocapsule 52 of the type shown in FIG. 5 is used to enclose a granular substrate 54 and tobacco 56. This macrocapsule is preferably positioned entirely within the ceramic fiber jacket 86. In addition, the lighting end 11 of fuel element 10 does not protrude beyond the forward end of fiber jacket 86. Preferably, the macrocapsule and the rear portion of the fuel element are surrounded by a piece of aluminum foil in a manner similar to that shown in FIG. 8.

Alternatively, the aluminum foil 52 which surrounds the substrate is not crimped at either end. In this embodiment, the rear end of the fuel element is inserted into one end of the foil and a polypropylene tube is inserted into the other end. The entire assembly is overwrapped with fiberglass to a diameter of a conventional cigarette.

The smoking article of the present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius and are uncorrected. In all instances, the articles have a diameter of about 7 to 8 mm, the diameter of a conventional cigarette.

EXAMPLE 1

A smoking article was constructed in accordance with the embodiment of FIG. 1. The fuel element was a 25 mm long piece of blow pipe charcoal, with five 0.040 in. (1.02 mm) longitudinally extending holes made with a number 60 drill bit. The charcoal weighed 0.375 g. The fuel element was wrapped with conventional treated cigarette paper. The substrate was 500 mg of glass beads (0.64 in. [1.63 mm] average diameter) having two drops, approximately 50 mg, of glycerol coated on their surface. When packed into the tube, this substrate was about 6.5 mm long. The foil lined tube consisted of a 0.35 mil (0.0089 mm) layer of aluminum foil inside a 4.25 mil (0.108 mm) layer of white spirally wound paper. This tube surrounded the rear 5 mm of the fuel element. A short (8 mm) piece of cellulose acetate with four grooves around the periphery was used to hold the glass beads against the fuel source. An additional grooved cellulose acetate filter piece of 8 mm length was inserted into the mouthend of the tube to give the appearance of a conventional cigarette. The overall length of the article was about 70 mm.

Models of this type delivered considerable aerosol on the lighting puff, reduced amounts of aerosol on puffs 2 and 3, and good delivery of aerosol on puffs 4 through 9. Models of this type generally yielded about 5–7 mg of wet total particulate matter (WTPM) when machine smoked under standard FTC smoking conditions of a 35 ml puff volume, a two second puff duration, and a 60 second puff frequency.

EXAMPLE 2

A. Four smoking articles were constructed with 10 mm long pressed carbon fuel elements and glass bead substrates. The fuel elements were formed from 90% PCB-G carbon and 10% SCMC, at about 5000 pounds (2273 kg) of applied load with the tapered lighting end illustrated in FIG. 2A. A single 0.040 in (1.02 mm) hole was formed down the center of each element. Three of the four fuel sources were wrapped with 8 mm wide strips of conventional cigarette paper. The fuel elements were inserted about 2 mm into 70 mm long sections of the foil lined tube described in Example 1. Glass beads, coated with the amount of glycerol indicated in the following table, were inserted into the open end of the foil lined tube and were held against the fuel element by 5 mm long foamed polypropylene filters having a series of longitudinally extending peripheral grooves. A 5 mm long low efficiency cellulose acetate filter piece was inserted into the mouthend of each article. These articles were machine smoked under standard FTC smoking conditions and the wet total particulate matter (WTPM) was collected on a series of Cambridge pads. The results of these experiments are reported in Table I.

TABLE I

| | Glass Beads (wt) | Aerosol Former (wt) | WTPM (mg)/Puffs 1–3 | 4–6 | 7–9 | 10–12 | Total |
|---|---|---|---|---|---|---|---|
| A | 400.4 mg | 40.5 mg | 8.1 | 4.5 | 0.9 | 0 | 13.5 |
| B* | 405.6 mg | 59.4 mg | 10.2 | 1.9 | 0.7 | 0 | 12.8 |
| C | 404.0 mg | 60.6 mg | 7.6 | 6.9 | 0.4 | 0 | 14.9 |
| D | 803.8 mg | 81.0 mg | 5.9 | 2.5 | 3.7 | 0.9 | 13.0 |

*The fuel rod in this model was not wrapped with cigarette paper.

B. Three smoking articles similar to those described in Example 2A were constructed with 20 mm long blowpipe charcoal fuel elements of the type described in Example 1. These articles were machine smoked under standard FTC smoking conditions, and the WTPM was collected on a series of Cambridge pads. The results of these tests are reported in Table II.

TABLE II

| | Glass Beads (wt) | Aerosol Former (wt) | WTPM (mg)/Puffs 1–3 | 4–6 | 7–9 | 10–12 | Total |
|---|---|---|---|---|---|---|---|
| E | 402.4 mg | 60.6 mg | 0.1 | 5.4 | 6.2 | 0.6 | 12.3 |
| F* | 404.7 mg | 63.1 mg | 0.5 | 0.9 | 2.2 | 3.1 | 7.0 |
| G | 500.0 mg | 50.0 mg | 0.3 | 2.9 | 3.0 | 0 | 6.2 |

*The fuel rod in this model was not wrapped with cigarette paper.

EXAMPLE 3

A. Four smoking articles were constructed as shown in FIG. 2 with a 10 mm pressed carbon fuel element having the tapered lighting end illustrated in FIG. 2A. The fuel element was made from 90% PCB-G carbon and 10% SCMC, at about 5000 pounds (2273 kg) of applied load. A 0.040 in. (1.02 mm) hole was drilled down the center of the element. The substrate for the aerosol former was cut and machined to shape from PC-25, a porous carbon sold by Union Carbide Corporation, Danbury, Conn. The substrate in each article was about 2.5 mm long, and about 8 mm in diameter. It was loaded with an average of about 27 mg of a 1:1 propylene glycol-glycerol mixture. The foil lined tube mouthend piece, of the same type as used in Example 1, enclosed the rear 2 mm of the fuel element and the substrate. A plug of burley tobacco, about 100 mg was placed against the mouthend of the substrate. A short, about 5–9 mm, baffled polypropylene filter piece was placed in the mouthend of the foil lined tube. A 32 mm length of a cellulose acetate filter with a hollow polypropylene tube in the core was placed between the tobacco and the filter piece. The overall length of each article was about 78 mm.

B. Six additional articles were constructed substantially as in Example 3A, but the substrate length was increased to 5 mm, and a 0.040 in (1.02 mm) hole was drilled through the substrate. In addition, these articles did not have a cellulose acetate/polypropylene tube. About 42 mg of the propylene glycol-glycerol mixture was applied to the substrate. In addition, two plugs of burley tobacco, about 100–150 mg each, were used. The first was placed against the mouthend of the substrate, and the second one was placed against the filter piece.

C. Four additional articles were constructed substantially as in Example 3A, except that an approximately 100 mg plug of flue-cured tobacco containing about six percent by weight of diammonium monohydrogen phosphate was used in lieu of the plug of burley tobacco.

D. The smoking articles from Examples 3A–C were tested using the standard Ames Test. See Ames, et al., *Mut. Res.*, 31: 347–364 (1975), as modified by Nagao et al., *Mut. Res.*, 42: 335 (1977), and 113: 173–215 (1983). The samples 3A and C were "smoked" on a conventional cigarette smoking machine using the conditions of a 35 ml puff volume, a two second puff duration, and a 30 second puff frequency, for ten puffs. The smoking articles of Example 3B were smoked in the same manner except that a 60 second puff frequency was used. Only one filter pad was used for each group of articles. This afforded the following wet total particulate matter (WTPM) for the indicated groups of articles:

| | WTPM |
|---|---|
| Example 3A | 63.4 mg |
| Example 3B | 50.6 mg |
| Example 3C | 69.2 mg |

The filter pad for each of the above examples containing the collected WTPM was shaken for 30 minutes in DMSO to dissolve the WTPM. Each sample was then diluted to a concentration of 1 mg/ml and used "as is" in the Ames assay. Using the procedure of Nagao et al., *Mut. Res.*, 42: 335–342 (1977), 1 mg/ml concentrations of WTPM were admixed with the S-9 activating system, plus the standard Ames bacterial cells, and incubated at 37° C. for twenty minutes. The bacterial strain used in this Ames assay was *Salmonella typhimurium*, TA 98. See Purchase et al., *Nature*, 264: 624–627 (1976). Agar was then added to the mixture, and plates were prepared. The agar plates were incubated for two days at 37° C., and the resulting cultures were counted. Four plates were run for each dilution and the standard deviations of the colonies were compared against a pure DMSO control culture. As shown in Table III, there was no mutagenic activity caused by the WTPM obtained from any of the smoking articles tested. This can be ascertained by comparison of the mean number of revertants per plate with the mean number of revertants obtained from the control (0 μg WTPM/Plate). For mutagenic samples, the mean number of revertants per plate will increase with increasing doses.

TABLE III

| Dose (μg WTPM/Plate) | | Mean Revertants/Plate | S.D.* |
|---|---|---|---|
| | | Example 3A | |
| Control | 0 | 49.3 | 3.4 |
| | 33 | 51.3 | 9.1 |
| | 66 | 50.5 | 7.0 |
| | 99 | 50.8 | 5.2 |
| | 132 | 51.5 | 5.3 |
| | 165 | 53.8 | 10.1 |
| | 198 | 48.3 | 4.6 |
| | | Example 3B | |
| Control | 0 | 56 | 10.5 |
| | 31.5 | 40 | 7.8 |
| | 63 | 48.3 | 6.3 |
| | 94.5 | 54.0 | 8.4 |
| | 126 | 39 | 4.7 |
| | 157.5 | 42.5 | 9.3 |
| | 189 | 43 | 9.1 |
| | | Example 3C | |
| Control | 0 | 48.3 | 5.7 |
| | 36 | 50.3 | 9.9 |
| | 72 | 49.0 | 3.9 |
| | 108 | 55.3 | 4.5 |
| | 144 | 43.0 | 6.4 |
| | 180 | 42.3 | 8.8 |
| | 216 | 44.3 | 7.8 |

*Standard Deviation

EXAMPLE 4

Five smoking articles were constructed as shown in FIG. 2. Each article had a 10 mm pressed carbon fuel source as described in Example 3A. This fuel element was inserted 3 mm into one end of a 70 mm long aluminum foil lined tube of the type described in Example 1. A 5 mm long carbon felt substrate, cut from rayon carbon felt sold by Fiber Materials, Inc., was butted against the fuel source. This substrate was loaded with an average of about 97 mg of a 1:1 mixture of glycerin and propylene glycol, about 3 mg of nicotine, and about 0.1 mg of a mixture of flavorants. A 5 mm long section of blended tobacco was butted against the mouthend of the substrate. A 5 mm long cellulose acetate filter piece was placed in the mouthend of the foil lined tube.

These articles were machine smoked under the standard FTC conditions. The aerosol from these articles was collected on a single Cambridge pad (133.3 mg WTPM), diluted in DMSO to a final concentration of 1 mg WTPM per ml and tested for Ames activity as described in Example 3D using each of the following strains: *Salmonella typhimurium* TA 1535, 1537, 1538, 98, and 100. As shown in Table IV there was no mutagenic activity caused by the WTPM collected from the articles tested.

TABLE IV

| Dose* | | Mean Revertants | Dose* | | Mean Revertants |
|---|---|---|---|---|---|
| TA 1535 | | | TA 1537 | | |
| Control | 0 | 16 | Control | 0 | 14 |
| | 25 | 13 | | 25 | 13 |
| | 50 | 14 | | 50 | 14 |
| | 75 | 17 | | 75 | 11 |
| | 100 | 14 | | 100 | 13 |
| | 125 | 13 | | 125 | 13 |
| | 150 | 12 | | 150 | 14 |
| TA 1538 | | | TA 98 | | |
| Control | 0 | 15 | Control | 0 | 61 |
| | 25 | 13 | | 25 | 62 |
| | 50 | 22 | | 50 | 47 |
| | 75 | 16 | | 75 | 42 |
| | 100 | 20 | | 100 | 44 |
| | 125 | 19 | | 125 | 39 |
| | 150 | 19 | | 150 | 40 |
| TA 100 | | | | | |
| Control | 0 | 110 | | | |
| | 25 | 109 | | | |
| | 50 | 105 | | | |
| | 75 | 99 | | | |
| | 100 | 107 | | | |
| | 125 | 108 | | | |
| | 150 | 109 | | | |

*μg WTPM/Plate

EXAMPLE 5

A smoking article was built as shown in FIG. 2 with a 10 mm pressed carbon fuel plug having the configuration shown in FIG. 2A, but with no tobacco. The fuel element was made from a mixture of 90% PCB-G activated carbon and 10% SCMC as a binder at about 5000 pounds (2273 kg) of applied load. The fuel element was provided with a 0.040 in (1.02 mm) axial hole. The substrate was a 10 mm long porous carbon plug made from Union Carbide's PC-25. It was provided with a 0.029 in. (0.74 mm) drilled axial hole, and was loaded with 40 mg of a (1:1) mixture of propylene glycol and glycerol. The foil lined tube, as in Example 1, encircled the rear 2 mm of the fuel element and formed the mouthend piece. The article did not have a filter tip, but was overwrapped with conventional cigarette paper. The total length of the article was 80 mm.

Figure 10:
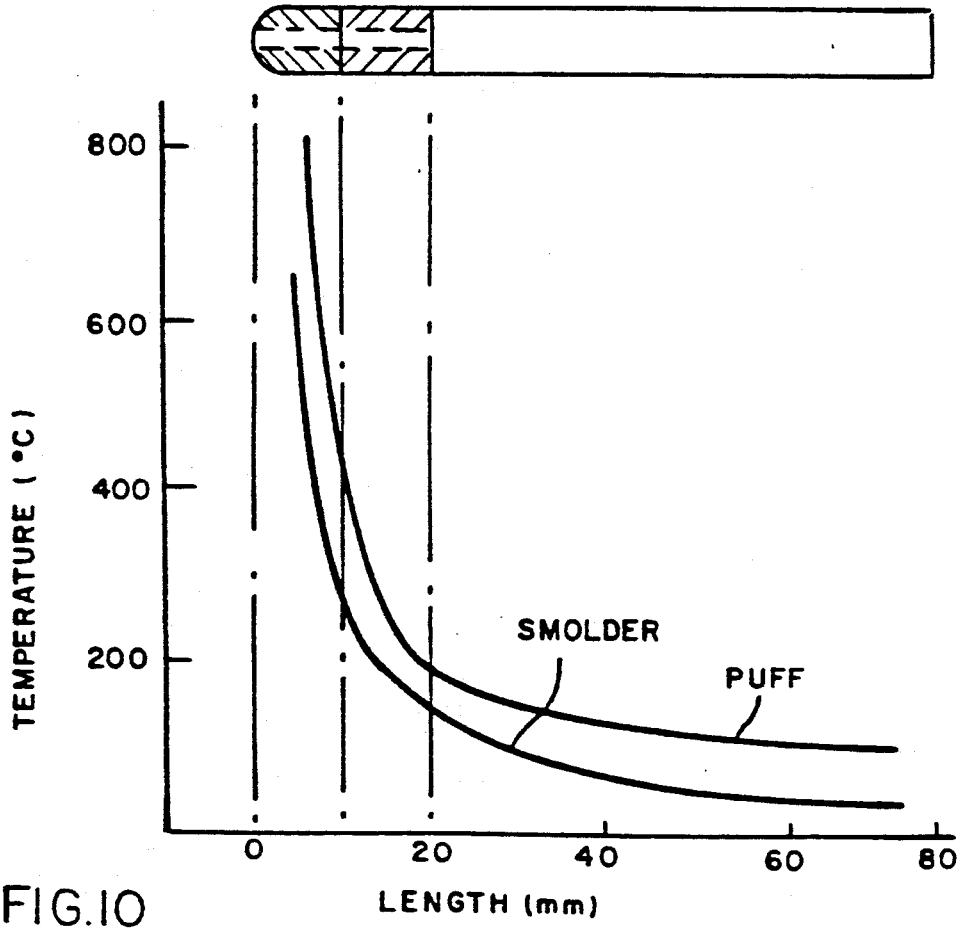
FIG. 10 is the average peak temperature profile of the smoking article of Example 5 during use.

The average peak temperatures for this article are shown for both "puff" and "smolder" in FIG. 10. As shown, the temperature declines steadily between the rear end of the fuel element and mouthend. This assures the user of no unpleasant burning sensation when using a product of this invention.

EXAMPLE 6

A smoking article was constructed in accordance with the embodiment of FIG. 3. The fuel element was a 19 mm long piece of blowpipe charcoal, with no holes. Embedded 15 mm into the fuel element was a ⅛ in. (3.2 mm) diameter aluminum rod, 28 mm in length. Four 9 mm×0.025 in. (0.64 mm) peripheral grooves, spaced 90° apart were cut into the portion of the aluminum rod which pierced the substrate. The substrate was Union Carbide PC-25 carbon 8 mm in length. The grooves in the aluminum rod extended about 0.5 mm beyond the end of the substrate toward the fuel. The substrate was loaded with 150 mg of glycerol. The foil lined tube, which was the same as in Example 1, enclosed a portion of the rear of the fuel element. A gap was left between the non-burning end of the fuel element and the substrate. A series of holes were cut through the foil lined tube in this gap region to allow for air flow. A similar smoking article was constructed with a pressed carbon fuel plug.

EXAMPLE 7

A smoking article was constructed as shown in FIG. 4 with a fuel source of carbonized cotton fiber. Four slivers of cotton were tightly braided together with cotton string to form a rope with a diameter of about 0.4 in. (10.2 mm). This material was placed in a nitrogen atmosphere furnace which was heated to 950° C. It took about 1½ hours to reach that temperature, which was then held for ½ hour. A 16 mm piece was cut from this pyrolyzed material to be used as the fuel element. A 2 mm axial hole 16 was made through the element with a probe. The fuel element was inserted 2 mm into a 20 mm long foil lined tube of the type described in Example 1. 100 mg of Union Carbide PC-25, in granular form, containing 60 mg of a 1:1 propylene glycol-glycerol mixture, was inserted into the foil lined tube. A 5 mm long plug of tobacco, about 60 mg, was located immediately behind the granular substrate in the foil lined tube. A 48 mm long annular cellulose acetate tube with an internal 4.5 mm I.D. polypropylene tube was inserted about 3 mm into the foil lined tube. A second foil lined tube, 50 mm in length, was inserted over the cellulose acetate tube until it abutted against the 20 mm foil lined tube. A 5 mm long cellulose acetate filter plug was inserted into the end of this second foil lined tube. The overall length was 84 mm. When lit, this article produced substantial amounts of aerosol throughout the first six puffs with a tobacco flavor.

EXAMPLE 8

A smoking article was constructed as shown in FIG. 5 with a 15 mm long fibrous fuel element substantially as described in Example 7. The macrocapsule 52 was formed from a 15 mm long piece of 4 mil (0.10 mm) thick aluminum foil, which was crimped to form a 12 mm long capsule. This macrocapsule was loosely filled with 100 mg of granulated PG-60, a carbon obtained from Union Carbide, and 50 mg of blended tobacco. The granular carbon was impregnated with 60 mg of a 1:1 mixture of propylene glycol and glycerol. The macrocapsule, the fuel element, and the mouthend piece were united by an 85 mm long piece of conventional cigarette paper.

EXAMPLE 9

A smoking article was constructed in accordance with the embodiment of FIG. 6 with a 7 mm long pressed carbon fuel element containing 90% PXC carbon and 10% SCMC. The center hole was 0.040 in. (1.02 mm) in diameter. This fuel plug was inserted into a 17 mm long aluminum foil lined tube so that 3 mm of the fuel element was inside the tube. An 8 mm diameter disc of 3.5 mil (0.089 mm) aluminum foil, with a 0.049 in. (1.24 mm) diameter center hole, was inserted into the other end of the tube and butted against the end of the fuel source.

Union Carbide PG-60 carbon was granulated and sieved to a particle size of −6 to +10 mesh. 80 mg of this material was used as the substrate, and 80 mg of a 1:1 mixture of glycerin and propylene glycol was loaded on this substrate. The impregnated granules were inserted into the foil tube and rested against the foil disk on the end of the fuel source. 50 mg of blended tobacco was loosely placed against the substrate granules. An additional foil disk with a 0.049 in. (1.24 mm) central hole was inserted into the foil tube on the mouthend of the tobacco. A long hollow cellulose acetate rod with a hollow polypropylene tube as described in Example 7 was inserted 3 mm into the foil lined tube. A second foil lined tube was inserted over the cellulose acetate rod against the end of the 17 mm foil lined tube.

This model delivered 11.0 mg of aerosol in the first three puffs when "smoke" under standard FTC smoking conditions. Total aerosol delivery for nine puffs was 24.9 mg.

EXAMPLE 10

A smoking article having the fuel element and substrate configuration of FIG. 7 was made using a 15 mm long annular pressed carbon fuel element with an inner diameter of about 4 mm and an outer diameter of about 8 mm. The fuel was made from 90% PCB-G activated carbon and 10% SCMC. The substrate was a 10 mm long piece formed of Union Carbide PC-25 carbon with an external diameter of about 4 mm. The substrate, loaded with 55 mg of a 1:1 glycerin/propylene glycol mixture, was inserted within the end of the fuel closer to the mouthend of the article. This fuel/substrate combination was inserted 7 mm into a 70 mm foil lined tube which had a short cellulose acetate filter at the mouthend. The length of the article was about 77 mm.

The article delivered substantial amounts of aerosol on the first three puffs, and over the useful life of the fuel element.

EXAMPLE 11

A modified version of the smoking article of FIG. 9 was made as follows: A 9.5 mm long carbon fuel source with a 4.5 mm diameter and a 1 mm diameter central hole was extruded from a mixture of 10% SCMC, 5% potassium carbonate, and 85% carbonized paper mixed with 10% water. The mixture had a dough-like consistency and was fed into an extruder. The extruded material was cut to length after drying at 80° C. overnight. The macrocapsule was made from a 22 mm long piece of 0.0089 mm thick aluminum formed into a cylinder of 4.5 mm I.D. The macrocapsule was filled with (a) 70 mg of vermiculite containing 50 mg of a 1:1 mixture of propylene glycol and glycerin, and (b) 30 mg of burley tobacco to which 6% glycerin and 6% propylene glycol had been added. The fuel source and macrocapsule were joined by inserting the fuel source about 2 mm into the end of the macrocapsule. A 35 mm long polypropylene tube of 4.5 mm I.D. was inserted in the other end of the macrocapsule. The fuel source, macrocapsule and polypropylene tube were thus joined to form a 65 mm long, 4.5 mm diameter segment. This segment was wrapped with several layers of Manniglas 1000 from Manning Paper Company until a circumference of 24.7 mm was reachad. The unit was then combined with a 5 mm long cellulose acetate filter and wrapped with cigarette paper. When smoked under standard FTC smoking conditions, the article delivered 8 mg of WTPM over the initial three puffs; 7 mg WTPM over puffs 4–6; and 5 mg WTPM over puffs 7–9. Total aerosol delivery over the 9 puffs was 20 mg. When placed horizontally on a piece of tissue paper, the article did not ignite or even scorch the tissue paper.

What is claimed is:

1. A cigarette-type smoking article comprising:

(a) a combustible carbonaceous fuel element which is less than about 30 mm in length prior to smoking;

(b) a physically separate aerosol generating means including a volatile substance; and (c) means for providing air to the aerosol generating means through the periphery of the article.

2. The article of claim 1, further comprising a heat conductive member in contact with the fuel element.

3. The article of claim 2, wherein the volatile substance is carried by a substrate located within a heat conductive member.

4. The article of claim 3, wherein the substrate comprises carbon.

5. The article of claim 1, 2, 3 or 4, wherein the periphery of the article includes at least two openings therein for providing a source of air to the aerosol generating means, the openings being longitudinally spaced from the fuel element.

6. The article of claim 1, 2, 3 or 4, wherein the fuel element includes an agent for modifying the burn characteristics thereof.

7. The article of claim 1, 2, 3 or 4, wherein the fuel element has a length of less than about 15 mm.

8. A cigarette-type smoking article comprising:

(a) a carbonaceous fuel element;

(b) a physically separate aerosol generating means bearing a volatile material; and (c) means for providing air to the aerosol generating means through the periphery of the article; the fuel element and the aerosol generating means being arranged in a conductive heat exchange relationship such that the aerosol generating means receives conductive heat transfer substantially throughout the burning of the fuel element.

9. The article of claim 8, further comprising a heat conducting member in contact with the fuel element.

10. The article of claim 9, wherein the volatile material is carried by a substrate contained within a heat conducting member.

11. The article of claim 8, wherein the fuel element is less than about 30 mm in length prior to smoking.

12. The article of claim 8, wherein the fuel element has a length prior to smoking of less than about 15 mm.

13. The article of claim 8, 9, 10, 11, or 12, wherein the periphery of the article includes at least two openings therein for providing a source of air to the aerosol generating means, the openings being longitudinally spaced from the fuel element.

14. A smoking article comprising:

(a) a combustible carbonaceous fuel element having a length of less than about 30 mm prior to smoking;

(b) aerosol generating means in heat exchange relationship with the fuel element; and (c) means for providing air to the aerosol generating means through the periphery of the article.

15. The article of claim 14, further comprising a heat conducting member in contact with the fuel element.

16. The article of claim 15, wherein the aerosol generating means includes a volatile material.

17. The article of claim 16, wherein the volatile material is carried by a substrate contained within a heat conducting member.

18. The article of claim 14 wherein the fuel element is less than about 20 mm in length.

19. The article of claim 14, wherein the fuel element has a length of less than about 15 mm.

20. The article of claim 14, 15, 16, 17, 18, or 19, wherein the periphery of the article includes at least two openings therein for providing a source of air to the aerosol generating means, the openings being longitudinally spaced from the fuel element.

21. A cigarette-type smoking article comprising:

(a) a carbonaceous fuel element;

(b) a physically separate aerosol generating means including a volatile material; and (c) air provision means, for providing air to the aerosol generating means, the air provision means consisting of means for providing air through the periphery of the article; the fuel element and the aerosol generating means being arranged in a conductive heat exchange relationship such that the aerosol generating means receives conductive heat transfer substantially throughout the time of burning of the fuel element.

22. A cigarette-type smoking article comprising:

(a) a carbonaceous fuel element;

(b) a physically separate aerosol generating means including a volatile material;

(c) means for providing air to the aerosol generating means through the periphery of the article; and (d) a heat conducting member in contact with the fuel element, which member contacts and transfers heat to air provided through the periphery of the article.

23. The article of claim 21 or 22 wherein the fuel element is less than about 20 mm in length prior to smoking.

* * * * *